United States Patent [19]

Seehase

[11] Patent Number: 4,486,966

[45] Date of Patent: Dec. 11, 1984

[54] SAFETY DEVICE FOR FIREARMS

[76] Inventor: Jack C. Seehase, 1200 Osceola Ave., Winter Park, Fla. 32789

[21] Appl. No.: 559,309

[22] Filed: Dec. 8, 1983

[51] Int. Cl.[3] ..... F41C 27/00

[52] U.S. Cl. ..... 42/1 N

[58] Field of Search ..... 42/1 N, 1 LP, 1 BC

[56] References Cited

U.S. PATENT DOCUMENTS

| | | | |
|---|---|---|---|
| 2,405,308 | 8/1946 | Jack | 42/1 N |
| 3,708,901 | 1/1973 | Wolter | 42/1 LP |
| 3,848,350 | 11/1974 | Seminiano | 42/1 N |
| 3,849,923 | 11/1974 | Hawkins | 42/1 N |
| 4,084,340 | 4/1978 | Scudder | 42/1 N |
| 4,100,693 | 7/1978 | Cech | 42/1 N |

*Primary Examiner*—Charles T. Jordan

*Attorney, Agent, or Firm*—Julian C. Renfro

[57] ABSTRACT

A safety indicator device for a firearm in conjunction with an energy absorbing device, for enabling hammer spring tension to be relieved without damage to the firing pin of the gun, comprising a generally cylindrical housing member approximately the size of a shotgun shell or a cartridge. In the end of the housing member opposite the primer end is a weighted member secured to the housing by a lanyard longer than the gun barrel, which weighted member can be dropped through the barrel immediately prior to inserting the housing member into the breech of the gun, to indicate that the gun is unloaded. Then, after the housing member has been inserted into the breech and the breech closed, the trigger of the gun can be pulled without possible damage to the firing pin, due to the inclusion of a nylon member in the housing, in place of the conventional primer, or any metallic spring device to absorb energy. This nylon member is mounted in a generally cylindrical insert, preferably of elastomeric material, which is firmly disposed in the housing member, which insert can deflect longitudinally to absorb energy when the nylon member is struck by the firing pin.

6 Claims, 8 Drawing Figures

SAFETY DEVICE FOR FIREARMS

BACKGROUND OF THE INVENTION

Many owners of shotguns, rifles and pistols utilize devices popularly known as "snap caps," which are components generally shaped like a shotgun shell or rifle cartridge, that can be readily slipped into the breech of a gun. These devices are intended to allow the tension on the hammer spring of the gun to be relieved without damage to the firing pin, and typically utilize a spring biased member placed in a central position, substantially corresponding to the primer of the shell or cartridge. Thus, when the gun user pulls the trigger, the firing pin is driven against a central member of the snap cap device which, because of its spring bias, serves to safely dissipate the energy of the firing pin that was driven forward by the hammer.

Although the use of these devices has been relatively widespread, it is also known that these prior art devices comprise numerous parts that bring about increased costs and decreased reliability, that are prone to get out of order, and significantly, the components utilized in these prior art devices need to be replaced from time to time.

It was in an effort to improve upon the prior art by designing a springless device for dissipating the energy of the firing pin, that the basic form of my invention was evolved.

In addition to the foregoing, it is a fact that shooters are greatly inconvenienced by the rules set for many state and national matches, to the effect that a shotgun must be carried in the breech-open position, thus to assure all the other shooters that each person's gun is not loaded, and therefore not likely to go off, with attendant loss of life. However, at such matches, any gun being stored in a gun rack must necessarily be in the closed position, and this serves to defeat the intent behind the above rule.

Not only have I provided in accordance with this invention, a snap cap type device requiring the use of no compression spring, but also I have evolved a type of safety indicator normally contained in the housing of the basic device that, when deployed, clearly indicates to all other shooters that each gun utilizing such device contains no live shell or cartridge in its breech.

SUMMARY OF THIS INVENTION

In accordance with this invention I have provided an energy-absorbing device enabling the tension of the hammer spring of the shotgun, rifle or pistol to be relieved without damage to the firing pin. I utilize a generally cylindrical housing member approximately the size of a corresponding shotgun shell or cartridge, which housing can easily be inserted into the breech of the gun. This housing has at the end corresponding to the primer of an ordinary shell or cartridge, a hole having cylindrical sides and a substantial depth. A generally cylindrical insert of elastometric material is arranged to fit tightly in the hole, preferably being bonded therein, with the hole having greater depth than the length of the insert. Also, the preferred embodiment of the elastomeric insert is equipped with a central aperture having less depth than the length dimension of the insert, thus to create a bottom portion of the insert that can flex without restraint.

My device also entails a central member of nylon or the like, that can be accommodated in the central aperture of the elastomeric insert. This central member is of a size closely approximating the length and diameter of the central aperture, with one end of the central member being approximately flush with the upper end of the housing member, thus being approximately in the position of the primer of a shell or cartridge, and with the other end of the central member being in contact with the bottom portion of the elastomeric insert.

When a properly sized device in accordance with this invention is placed in the breech of a gun, the gun user can proceed to pull the trigger and thus relieve the tension of the hammer spring of the gun, without this act serving to possibly damage the firing pin of the shotgun, rifle or pistol. This is because when the firing pin impacts said other end of the central member, because the latter member is of a hard, non-metallic material, such as nylon, this member moves longitudinally, with said bottom portion of the insert serving to flex to accommodate such motion, and thereby effectively dissipate the energy of the firing pin of the gun.

Although my device as just described serves an important purpose in a satisfactory and inexpensive manner, its design can further include a lanyard contained in a recess in the opposite end of the housing. One end of such lanyard is attached to an interior portion of the recess, or to the forward end of the nylon central member, whereas the other end of the lanyard is attached to a weighted member arranged to fit in the other end of the recess. The weighted member can readily be removed from the recess, and then, immediately before inserting the cylindrical housing into the breech of the gun, the weighted member can readily be dropped through the barrel of the gun. The weighted member is smaller than the bore of the gun, and will fall through without sticking, and emerge from the muzzle end of the gun. The shooter then inserts the cylindrical housing into the breech of the gun.

At this point, the breech of the gun can be closed, and the shotgun or rifle placed butt down on the floor against a wall, or in a gun rack, with the weighted member serving as a safety indicator by dangling from its lanyard some two or three inches below the muzzle of the gun. The presence of this weighted member clearly exhibits to all beholders that no live ammunition is contained in the breech of the gun. As is apparent, the snap cap characteristics of my basic housing device make it possible for the tension of the hammer spring to be relieved without injury to the firing pin, just before the shotgun or rifle is placed in a gun rack or its case.

It is therefore a principal object of my invention to provide an improved type of snap cap device for relieving the hammer spring of a shotgun, rifle or pistol in a non-damaging way, without utilizing any metallic component, such as a short compression spring, as provided in accordance with prior art snap cap teachings.

It is another object of my invention to provide an economical and effective energy dissipating device for enabling a gun owner to readily and safely remove the tension from the hammer spring of his gun before storing same.

It is yet another object of my invention to provide in the housing of my device, at the end opposite the energy dissipating device, a weighted member disposed at the end of an anchored lanyard, which weighted member can be dropped through the gun barrel to serve as a clear indication of there being no live round of ammunition in the breech of the gun.

Figures 3, 4, 5, 6:
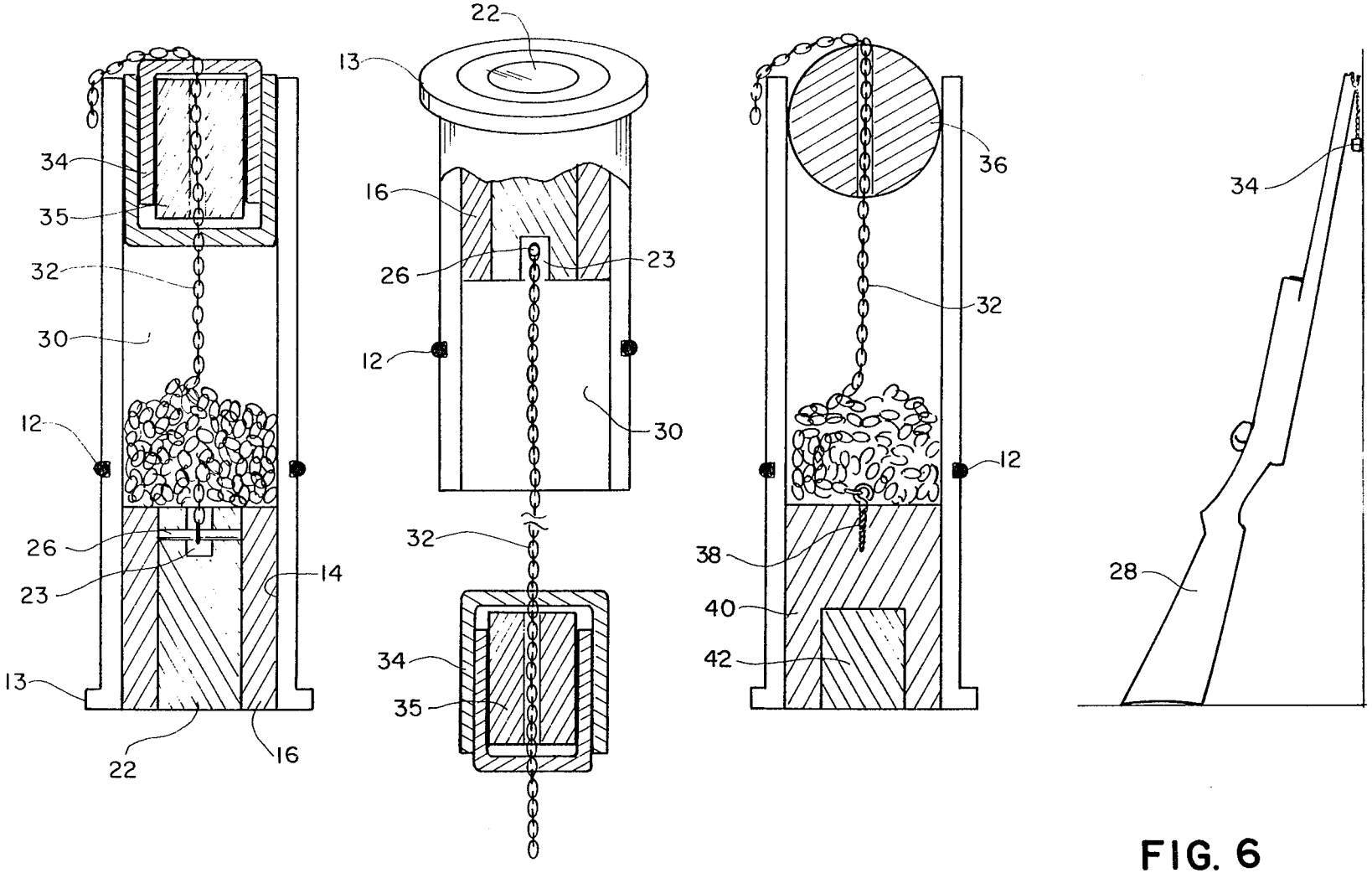

FIGS. *2a* and *2b* represent other elastomeric insert-central member arrangements that can be used;

FIG. 3 is a cross-sectional view of an embodiment of my invention in which a safety indication device may be used in the generally cylindrical housing member;

FIG. 4 reveals the device of FIG. 3 in an instance in which the housing member has been inverted, such that the weighted safety indicator member hangs below the housing member;

FIG. 5 is an embodiment in which the weighted member takes a different configuration, and in which the preferred energy-absorbing arrangement of my invention is not used; and FIG. 6 reveals a stacked shotgun or rifle, with my novel safety indication device utilized to reveal that no live shell or cartridge is in the gun.

DETAILED DESCRIPTION

Figure 1:
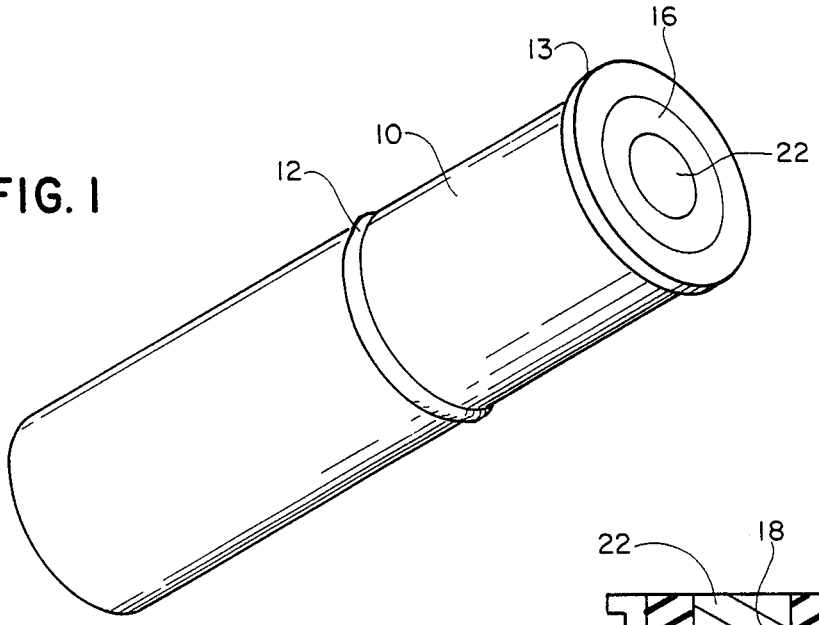
FIG. 1 is a perspective view of a first embodiment of my invention, revealing external details of my novel energy-dissipation arrangement.

Turning to FIG. 1, it will there be seen that I have provided a housing 10 adapted to be received in the breech of a shotgun, rifle or pistol, which housing may be made of hard plastic, or a light metal such as aluminum. A circumferential groove may be provided about a mid portion of the exterior of the housing, in which is accommodated an O-ring 12. Although the O-ring is not a vital part of my invention, it nevertheless makes it possible for the housing 10 to be made slightly smaller than the breech, yet be snugly received in the breech. A rim 13 prevents the housing from passing too far into the breech of the gun, and allows the extractor part of the gun mechanism to raise the housing 10 out of the chamber when the breech is opened.

I utilize the word "gun" to connote a portable firearm, and to include a shotgun, rifle or pistol.

Figure 2A:
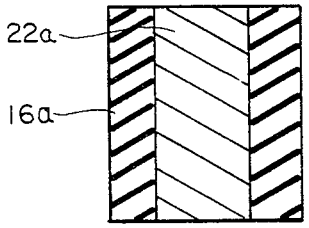
FIG. 2 is a cross-sectional view of the device of FIG. 1, showing significant details of the elastomeric insert, and its relationship to a non-metallic central member.
Figure 2:
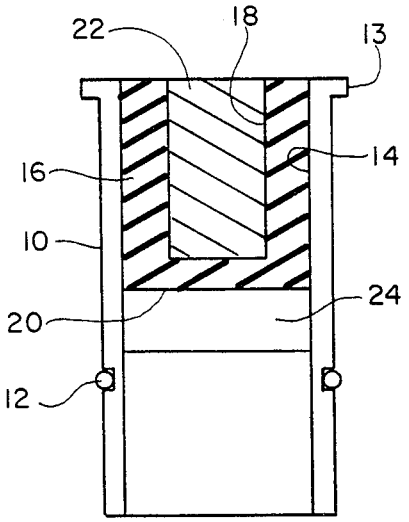
Figure 2B:
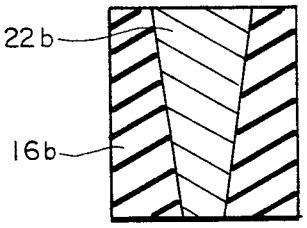

As best seen in FIG. 2, a hole 14 is cut or formed in the housing member 10, and in this hole is received a generally cylindrical insert 16 of elastomeric material. A central aperture 18 is contained in the insert of elastomeric material, but as visible in FIG. 2, this aperture preferably is not of such depth as to pass entirely through the insert 16. As a result, a bottom portion 20 of the insert remains which, as pointed out hereinafter, may flex on occasion in order that the energy of a hammer spring can be safely dissipated. Desirably, a space 24 will exist between the bottom 20 of the insert 16 and the bottom of the hole 14. Alternatively, a throughbore may be utilized in housing member 10.

A central member 22 is inserted in the central aperture 18 of the insert member 16, with the diameter thereof closely corresponding to the diameter of the central aperture, and the length of this central member closely corresponding to the depth of the central aperture. The member 22 is deliberately made of a relatively hard and unyielding non-metallic material, such as nylon, so any force or pressure applied to the upper end of the central member 22 as viewed in FIG. 1 or 2, will cause some downward movement of this central member such that it pushes against the bottom portion 20 of the insert 16. At such a time, the bottom portion 20 serves as a type of spring, serving to push the central member 22 back up again to the position in which its upper portion is again flush with the upper end of the housing 10, as viewed in FIGS. 1 and 2. As previously mentioned, no part of the housing member interferes with this motion.

As should now be obvious, the generally cylindrical housing member 10 can be inserted in the breech of a gun, in the manner as would have been done in the case of a shotgun shell or cartridge, with the rim 13 of the housing member 10 serving to prevent too deep an entry into the breech.

With my novel device in the breech of the gun, breech closure can be effected, and thereafter the trigger pulled to cause the firing pin to be driven against the hard central member 22. This is sometimes referred to as "dry firing". As explained hereinbefore, the elastomeric insert 16 serves in the manner of a spring to dissipate the energy of the firing pin driven against the exposed upper end of the central member. Since, as previously mentioned, this central member is preferably of nylon and thus non-metallic, the active end of the firing pin will not be "peened", nor the pin itself fractured by its sudden contact with the member 22.

Although I prefer the use of an insert as configured in FIG. 2, I may instead utilize a relationship of the insert and the central member as shown in FIG. *2a*, wherein no bottom portion 20 is used, and the central member *22a* is held in contact with the insert *16a* by bonding, or by mechanical means. FIG. *2b* shows another embodiment, in which the central aperture of the insert *16b* has tapering inner sides, with the hole at the bottom smaller than the hole at the top. The central member *22b* is contoured to fit tightly in this central aperture, such that it cannot pass through the insert *16b*. In both of these latter embodiments, the sidewalls of the elastomeric insert provide the spring action.

FIG. 3 shows a further refinement of my invention, in which the housing is made longer, and has no closed end, thus creating a substantial amount of usable space, hereinafter referred to as a cavity or recess 30. Quite obviously, this recess is on the end opposite the rim 13. A lanyard 32 of substantial length is anchored preferably to the central member 22, typically by providing a hole 23 in one end of the latter member, and then inserting a pin 26 through the hole, such as at 90 degrees thereto. If the lanyard is in the form of a chain, the pin 26 passes through the end link thereof.

To the other end of this lanyard a weighted member, preferably a plug 34 of a preascertained size, is secured. This plug may take the form of a pair of plastic members, generally known as cap plugs, that have been interfitted. Such devices are made by Sinclair-Rush of St. Louis, Mo. One of the cap plugs is one size smaller than the other one, and in the interior of the smaller one, a lead sinker is inserted. The larger member is then inserted over the end of the smaller one, so as to trap the sinker inside. Although the fit is usually tight, non-separation of the cap plugs can be assured by the use of a suitable adhesive. As is apparent in FIGS. 3 and 4, the chain, or other form of lanyard, passes through the several components of the plug 34.

The larger cap plug is of a diameter to fit closely inside the outer end of the central recess 30, and a thin coating of plastic on the upper interior portion of the recess makes it relatively easy to insert and remove the member 34. Alternatively, the weighted safety indicator 34 can be constructed to have elasticity, such that it can function in the general manner of a cork in a bottle.

Because the weighted member 34 is smaller than the inside diameter of the barrel of the shotgun, rifle or pistol with which it is used, this weighted member can be dropped through the barrel just before the shooter inserts the housing member 10 in the breech of the gun. The lanyard 32 had previously been selected to be slightly longer than the length of the barrel of the gun, which means that the weighted member can extend some two or three inches outside the muzzle end of the barrel; note FIG. 6. This weighted member, which may be brightly colored, thus effectively serves as a safety indication device, assuring all beholders that a live round of ammunition does not reside in the breech of the gun.

It should now be clear that the lanyard 32 can be of cord, or a small chain can be used, but it is to be understood that the weighted member 34 must be heavier than the weight of the lanyard. Otherwise, when the shotgun or rifle is placed butt end down, against a wall or in a rack, the weighted member would be pulled back into the barrel if the lanyard is made of chain or any other component that is heavier than the weighted member, thus defeating the basic purpose of using the safety indicator 34.

Obviously, it is not required that my novel energy dissipating feature described hereinbefore be used in conjunction with my safety device, and FIG. 5 shows such an embodiment. In this latter embodiment, I may prefer a sphere 36 used as the safety indicator at the end of the lanyard remote from the housing 10, instead of the previously described plug 34. In the embodiment of FIG. 5, a solid member 40 may be used in the bottom of the housing, and a screw eye 38 affixed in the member 40 serves as the anchor for the lanyard. Also in this embodiment, a plug of nylon 42 may be used in the lower central portion of the housing, which is struck by the firing pin when the trigger of the gun is pulled.

Although I am not to be so limited, I nevertheless prefer to use the energy dissipation device as described in the embodiment revealed in FIGS. 2 through 4 in conjunction with my safety indication arrangement, for its use makes it possible to dissipate a considerably larger number of firing pin releases in a "dry firing" mode without jeopardy to the integrity of the firing pin, than does the embodiment of FIG. 5 utilizing members 40 and 42.

I claim:

1. An energy-absorbing device for use in a shotgun, rifle, pistol, or other gun equipped with a barrel having a bore therein, a breech, a hammer spring, a firing pin and a trigger, said device enabling the tension on the hammer spring of the gun to be relieved without damage to the firing pin, said device comprising a generally cylindrical housing member approximately the size of the corresponding shotgun shell or cartridge, said housing having at the end corresponding to the primer, a hole having cylindrical sides and a substantial depth, a generally cylindrical insert of elastomeric material arranged to fit tightly in said hole, said elastomeric insert being equipped with a central aperture, a non-metallic central member of a size closely approximating the length and diameter of said central aperture, being disposed in said central aperture, with one end being approximately flush with said end of said housing member, thus to place said one end of said central member approximately in the position of the primer of a shell or cartridge, whereby upon said device being placed in the breech of the gun and the trigger pulled, the firing pin impacts said one end of said central member, causing the latter member to move longitudinally, with said elastomeric insert acting as a non-metallic type of spring member, such that the interaction of said central member and elastomeric insert serves to safely dissipate the energy of the firing pin of the gun during the dry firing thereof, the central aperture of said elastomeric insert being of a depth less than the length of said elastomeric insert, thus to create a bottom portion that is contacted by the other end of said central member.

2. The energy-absorbing device as recited in claim 1 in which a central recess is provided in the end of said housing opposite from said hole in said one end, a lanyard of substantial length in said recess, with one end of said lanyard secured inside said recess, and a weighted member of a size to closely fit inside said recess being attached to the other end of said lanyard, said weighted member being smaller than the bore of the gun, said lanyard being slightly longer than the length of the barrel of the gun, such that immediately prior to said housing being inserted into the breech of the gun, said weighted member can be dropped down the barrel, and thereafter hang outside the end of the barrel, to serve as a safety indicator, in that the gun contains no live shell.

3. An energy-absorbing device for use in a shotgun, rifle, pistol or other gun equipped with a barrel having a bore therein, a breech, a hammer spring, a firing pin and a trigger, said device enabling the tension on the hammer spring of the gun to be relieved without damage to the firing pin, said device comprising a generally cylindrical housing member approximately the size of the corresponding shotgun shell or cartridge, said housing having at the end corresponding to the primer, a hole having cylindrical sides and a substantial depth, a generally cylindrical insert of elastomeric material arranged to fit tightly in said hole, but having less length than the depth of said hole, such that a space is created, said elastomeric insert equipped with a central aperture having less depth than the length dimension of said insert, thus to allow a bottom portion to remain, a non-metallic central member of a size closely approximating the length and diameter of said central aperture, one end of said central member being approximately flush with said end of said housing member, thus to place said one end of said central member approximately in the position of the primer of a shell or cartridge, and the other end thereof in contact with the bottom portion of said elastomeric insert, whereby when the firing pin impacts said one end of said central member, the latter member moves longitudinally, with said bottom portion of said elastomeric insert acting as a non-metallic type of spring member, such that the interaction of said central member and elastomeric insert serves to safely dissipate the energy of the firing pin of the gun during the dry firing thereof.

4. The energy-absorbing device as recited in claim 3 in which a central recess is provided in the end of said housing opposite from said hole in said one end, a lanyard of substantial length in said recess, with one end of said lanyard secured inside said recess, and a weighted member of a size to closely fit inside said recess being attached to the other end of said lanyard, said weighted member being smaller than the bore of the gun, said lanyard being slightly longer than the length of the barrel of the gun, such that immediately prior to said housing being inserted into the breech of the gun, said weighted member can be dropped down the barrel, and thereafter hang outside the end of the barrel, to serve as a safety indicator, in that the gun contains no live shell.

5. A readily reusable safety indication device for use in a shotgun, rifle, pistol, or other gun equipped with a barrel having a bore therein, a breech, a hammer spring, a firing pin and a trigger, said device enabling the tension of the hammer spring of the gun to be relieved without damage to the firing pin, said device comprising a generally cylindrical housing member approximately the size of a corresponding shotgun shell or rifle or pistol cartridge, said housing having on its primer end, a non-metallic central member mounted to dissipate the energy of the firing pin, and having on the end opposite the primer end, a central recess in which is provided a lanyard of substantial length, with one end of said lanyard secured inside said recess, and a weighted member of a size to closely fit inside said recess being attached to the other end of said lanyard, said weighted member normally acting as a closure for said recess, to keep said lanyard inside when it is not being deployed down a gun barrel, said lanyard being slightly longer than the length of the barrel of the gun, such that immediately prior to said housing being inserted into the breech of the gun, said weighted member can be dropped down the barrel, and thereafter hang on said lanyard outside the end of the barrel, to indicate that the gun contains no live shell.

6. The readily reusable safety indication device as recited in claim 5 in which said non-metallic central member is closely received in an elastomeric member that provides a spring-type action for said non-metallic central member.

* * * * *